US007628478B2

(12) United States Patent
Inoue

(10) Patent No.: US 7,628,478 B2
(45) Date of Patent: Dec. 8, 2009

(54) INK CONTAINER, INK JET RECORDING APPARATUS, INK FILLING METHOD, AND INK FILLING DEVICE

(75) Inventor: Hiroshi Inoue, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 521 days.

(21) Appl. No.: 11/512,311

(22) Filed: Aug. 30, 2006

(65) Prior Publication Data

US 2007/0046742 A1 Mar. 1, 2007

(30) Foreign Application Priority Data

Aug. 31, 2005 (JP) ..... 2005-252089

(51) Int. Cl.
*B41J 29/38* (2006.01)
*B41J 2/195* (2006.01)
*B41J 2/175* (2006.01)

(52) U.S. Cl. ..... 347/85; 347/6; 347/7; 347/86

(58) Field of Classification Search ..... 347/6, 347/7, 85, 86

See application file for complete search history.

(56) References Cited

U.S. PATENT DOCUMENTS 6,260,961 B1 * 7/2001 Seu et al. ..... 347/87
6,419,349 B1 * 7/2002 Iwanaga et al. ..... 347/86

FOREIGN PATENT DOCUMENTS

JP 2002-200774 A 7/2002

* cited by examiner

*Primary Examiner*—Matthew Luu
*Assistant Examiner*—Jannelle M Lebron
(74) *Attorney, Agent, or Firm*—Birch, Stewart, Kolasch & Birch, LLP

(57) ABSTRACT

An ink cartridge is formed with an ink outlet, which is connected to an ink jet type recording head through an ink supply path. Ink filling openings are formed around the ink outlet. To refill the ink cartridge with ink, the ink filling openings are connected through an ink filling tube to an ink supply tank. A pump mechanism first reduces pressure inside the ink supply tank, to suck ink residue out of the ink cartridge through the ink filling openings and collect the ink residue into the ink supply tank. Thereafter, the pump mechanism applies pressure to ink in the ink supply tank, to send the ink from the ink supply tank through the ink filling tube and the ink filling openings into the ink cartridge.

18 Claims, 10 Drawing Sheets

START SUCKING INK RESIDUE

COMPLETE SUCKING INK RESIDUE

INK FILLING

INK FILLING

REMAINING AMOUNT OF INK > GIVEN VALUE

INK CONTAINER, INK JET RECORDING APPARATUS, INK FILLING METHOD, AND INK FILLING DEVICE

FIELD OF THE INVENTION

The present invention relates to an ink container containing ink to be supplied to an ink jet type recording head, an ink jet recording apparatus using the ink container, and a method of and a device for filling the ink container with ink.

BACKGROUND OF THE INVENTION

An ink jet recording apparatus has been known, which has a recording head for discharging ink as droplets onto a recording medium to print an image. The ink jet recording apparatus is provided with at least an ink container containing ink, to supply the ink from the ink container to the recording head. In a serial ink jet recording apparatus, a recording head is mounted to a carriage that moves back and forth in a main scanning direction, a widthwise direction of a recording paper. Each time the carriage makes one lap, the recording head records a line of image, and then the recording paper is fed in a sub scanning direction orthogonal to the main scanning direction by an amount corresponding to the image line. Thus, an image frame is printed serially line after line.

Because the ink is a consumable material, the ink container is often formed as a cartridge that is removably attached to the ink jet recording apparatus, so as to make it easy to refill the ink. Such a cartridge type ink container, hereinafter called the ink cartridge, is attached to the carriage carrying the recording head, mostly above the recording head.

In an ink jet recording apparatus where an ink cartridge is disposed above a recording head, an ink load in the ink cartridge becomes positive to inner pressure of the recording head, which causes a concern that the ink could leak out of the nozzle of the recording head. Therefore, in order to keep the pressure in the recording head negative, a negative pressure generation member is disposed in the ink cartridge. The negative pressure generation member is a porous material, including for example a sponge. Due to its capillary force, the negative pressure generation member absorbs and holds the ink in the ink cartridge. Thereby, the inner pressure of the recording head, which is interconnected through an ink supply path to the ink cartridge, is kept negative. Forming meniscuses in the nozzles of the recording head prevents the ink from leaking out of the nozzles.

Japanese Laid-open Patent Application No. 2002-200774 discloses a method of filling such a cartridge with ink. As shown in FIG. 12A, an ink cartridge 121 in the patent document contains a negative pressure generation member 123 in a case 122 which stores ink, and an ink outlet 124 for supplying the ink to a recording head is disposed on a bottom of the case 122. As the ink decreases with the supply of the ink, air is led through an air inlet 126 into the case 122. In the air inlet 126, a gas-liquid separation filter is provided, which does not let liquid pass through it, but only gas.

Since a not-shown filter or valve is placed in the ink outlet 124, flow resistance through the ink outlet 124 is large. Therefore, besides the ink outlet 124, the ink cartridge 121 has an ink filling opening 128 formed through a side wall of the case 122. For the ink filling, an ink supply tank 130 is connected to the ink filling opening 128, and a sucking pump sucks the air from the case 122 through the air inlet 126, to decompress the air inside the case 122. Thereby, the ink moves from the ink supply tank 130 into the case 122.

The ink filling opening 128 is arranged such that a distance L1 from the ink supply outlet 128 to the ink outlet 124 is shorter than a distance L2 to the air inlet 126. Thereby, the ink entering through the ink filling opening 128 reaches the ink outlet 124 faster than the air inlet 126 and the ink go around the ink outlet 124. This configuration is for preventing formation of air pools around the ink outlet 124, the air pool being a room in which only air exists but no ink exists. The air pools around the ink outlet 124 result in forming air bubbles in the nozzles, which chokes the nozzles and causes defective discharge.

As shown in FIG. 12B, however, if there is ink residue 132 around the ink outlet 124 and an air pool 133 is formed in the ink outlet 124 when the ink cartridge 121 is refilled with ink, flow resistance against the ink is larger in the area where the air pool 133 exits than the area where the ink residue 132 exits. Therefore, there are concerns that the ink taken from the ink supply tank 130 may not flow into the air pool 133, so the air pool 133 may stay after the refill of the ink.

SUMMARY OF THE INVENTION

In view of the foregoing, a primary object of the present invention is to provide an ink container that contains a negative pressure generation member for absorbing and holding ink by its capillary force, and a method of filling the ink container with the ink, whereby the ink container is refilled with the ink without generating any air pool at an ink outlet.

Another object of the present invention is to provide an ink filling device for the ink container of the invention, and an ink jet recording apparatus for use with the ink container of the invention.

According to the present invention, an ink container containing ink to be supplied to an ink jet type recording head, comprises a case formed with an ink chamber for containing the ink; an ink outlet formed through the case and connected to an ink supply path which leads to the recording head; a negative pressure generation member placed in the ink chamber, the negative pressure generation member absorbing and holding the ink by its capillary force to keep pressure inside the recording head negative to atmospheric pressure; an air inlet formed through the case, for introducing air into the ink chamber with consumption of the ink in the ink chamber; and at least an ink filling opening formed through the case in a peripheral area around the ink outlet, the ink filling opening being used to fill the ink chamber with the ink.

Preferably, the ink filling openings are arranged at equal intervals in a circle around the ink outlet. For example, a couple of ink filling openings are arranged across the ink outlet from each other.

The ink filling opening may be an almost annular opening that surrounds the ink outlet.

An ink jet recording apparatus of the present invention comprises a recording head that discharges ink to print an image; and at least an ink container containing the ink to be supplied to the recording head, the ink container comprising a case forming an ink chamber, an ink outlet formed through the case and connected to the recording head, a negative pressure generation member placed in the ink chamber, for absorbing and holding the ink by its capillary force to keep pressure inside the recording head negative to atmospheric pressure, an air inlet formed through the case, for introducing air into the ink chamber with consumption of the ink in the ink chamber, and at least an ink filling opening formed through the case in a peripheral area around the ink outlet, the ink filling opening being used to fill the ink chamber with the ink.

According to a preferred embodiment, the ink jet recording apparatus further comprises an ink supply tank that contains ink to be supplied to the ink container, an ink filling path that connects the ink supply tank to the ink filling opening of the ink container, and a pump device that applies pressure to the ink in the ink supply tank, to send the ink from the ink supply tank through the ink filling path into the ink container.

It is preferable to provide the ink jet recording apparatus with a detection device for detecting an ink filling time to fill the ink container with the ink from the ink supply tank, and a control device for controlling the pump based on a detection signal from the detection device.

Preferably, the ink jet recording apparatus further comprises a device for detecting a remaining amount of ink in the ink container, wherein if the remaining amount of ink is less than a given amount at the ink filling time, the control device executes a first filling mode wherein the ink is sent from the ink supply tank to the ink container after the ink is sucked out of the ink container, whereas if the remaining amount of ink is not less than the given amount at the ink filling time, the control device executes a second filling mode wherein the ink is sent from the ink supply tank to the ink container without the ink residue being sucked out of the ink container.

A method of filling the ink container of the present invention with ink comprises steps of sucking ink residue that stays around the ink outlet through the ink filling opening out of the ink chamber, and injecting, thereafter, the ink through the ink filling opening into the ink chamber.

An ink filling device for filling the ink container of the present invention with ink comprises an ink supply tank containing ink to be supplied to the ink container; an ink filling path connecting the ink supply tank to the ink filling opening of the ink container; and a pump device that applies pressure to the ink in the ink supply tank, to send the ink from the ink supply tank through the ink filling path into the ink container, wherein the pump device sucks ink residue staying around the ink outlet out of the ink container through the ink filling opening, before starting refilling the ink container with the ink.

Since the ink filling openings are provided in the periphery of the ink outlet, and the ink residue is sucked out through the ink filling opening before injecting the ink into the ink container through the ink filling openings, the ink container is refilled with the ink without generating any air pool at the ink outlet. Therefore, the nozzles are prevented from choking with air bubbles, so the stability of ink discharging operation of the recording head is ensured.

BRIEF DESCRIPTION OF THE DRAWINGS

The above and other objects and advantages of the present invention will be more apparent from the following detailed description of the preferred embodiments when read in connection with the accompanied drawings, wherein like reference numerals designate like or corresponding parts throughout the several views, and wherein.

DESCRIPTION OF THE PREFERRED EMBODIMENTS

Figure 1:
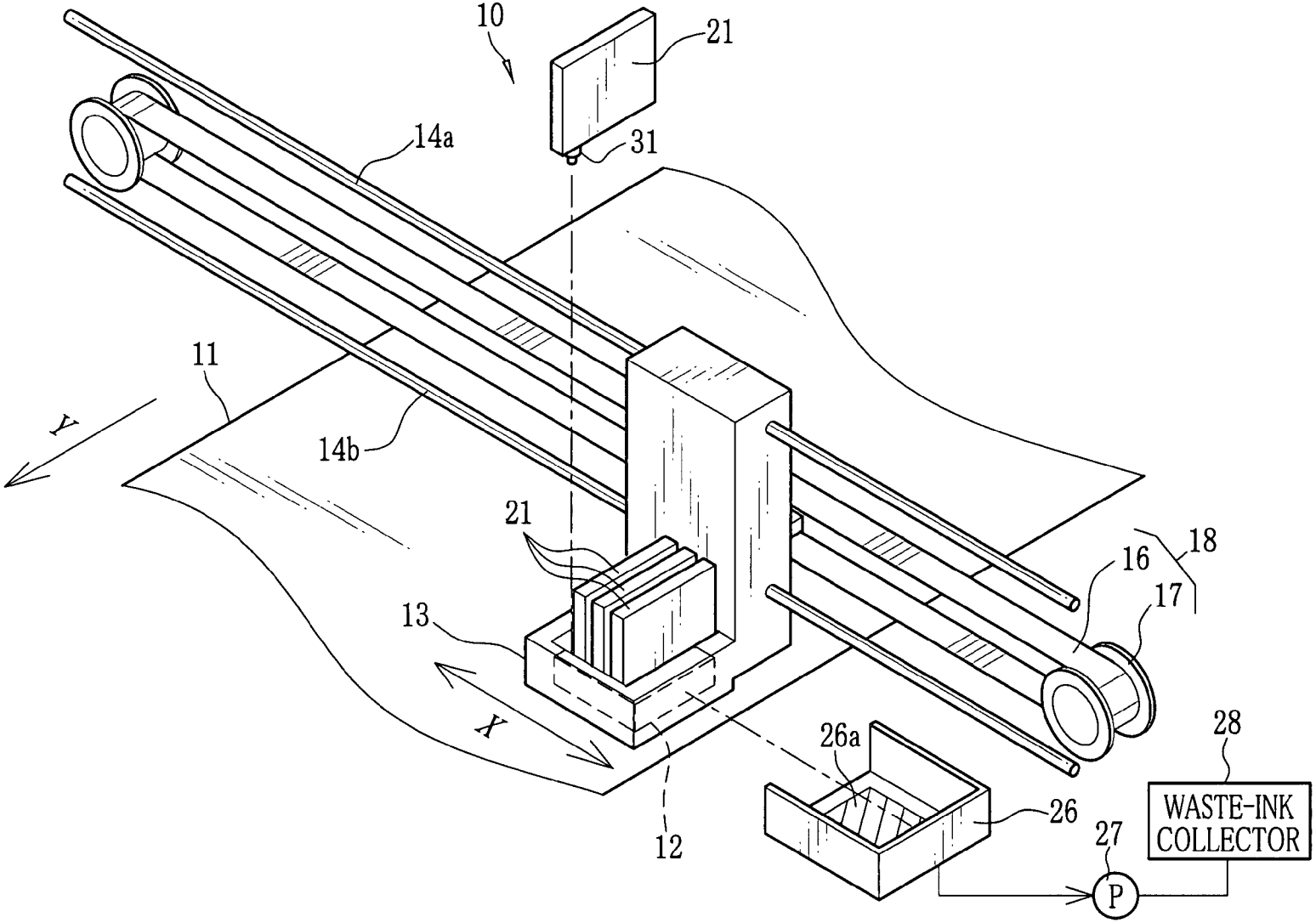
FIG. 1 is an explanatory diagram illustrating essential elements of an ink jet recording apparatus according to an embodiment of the invention.

An ink-jet recording apparatus 10 shown in FIG. 1 is provided with a recording head 12 that discharges ink toward a recording paper 11 to print images thereon. The recording head 12 is provided with a plurality of not-shown nozzles for discharging the ink from individual outlets. The outlets of the nozzles are aligned in a plane to form a discharging surface, and the discharging surface is placed in face to a recording surface of the recording paper 11. The recording head 12 is mounted in a carriage 13 that is movable in a widthwise direction of the recording paper 11, that is, a main scanning direction X. The discharging surface is exposed through an opening formed through a bottom of the carriage 13. While reciprocating in the widthwise direction of the recording paper 11 together with the carriage 13, the recording head 12 records an image in a line sequential fashion. Each time the recording head 12 makes one lap to record a line of the image, the recording paper 11 is fed by not-shown conveyer rollers in a sub scanning direction Y that is orthogonal to the main scanning direction X, by a length corresponding to a width of each image line as recorded by the recording head 12. Thus, the image of one frame is recorded line by line.

The carriage 13 is mounted on a pair of guide rods 14*a* and 14*b* to slide thereon, and is driven by a belt mechanism 18 consisting of a belt 16 and a pair of pulleys 17. The carriage 13 carries detachable ink cartridges 21 above the recording head 12, e.g. four cartridges containing inks of four different colors: yellow, magenta, cyan and black. The carriage 13 is provided with not-shown slots, into which the ink cartridges 21 are plugged.

The ink cartridge 21 is attached so that its underside goes to a bottom of the slot. When the ink cartridges 21 are set in the carriage 13, the ink cartridges 21 are connected to the recording head 12 through respective ink supply paths. In the recording head 12, oscillation plates are provided in one-to-one relationship with pressure chambers. Each of the oscillation plates is driven individually by a piezoelectric element, to change the pressure. Thereby, the ink in the ink cartridge 21 is sucked into the pressure chamber, and is ejected from the outlets of the nozzles that are connected to the pressure chamber.

While the recording head 12 is not working, the carriage 13 stands by at a home position retreating from a paper path of the recording paper 11. The home position of the carriage 13 is where the ink cartridges 21 are exchanged. In the home position, a head cap 26 is placed to cover the discharging surface of the recording head 12 from below and to receive the ink spilt from the discharging surface. In face to the discharging surface of the head cap 26, a sucking surface 26*a* is placed to suck the ink that is stuck in ends of the nozzles. The head cap 26 is connected to a sucking pump 27, which sucks the stuck ink out of the nozzles through the sucking surface 26*a*, to mend defective discharge of the recording head 12. The ink as sucked by the sucking pump 27 is collected into a waste-ink collector 28. Such a head cleaning by the sucking pump 27 is regularly carried out, for example, according to the number of print or after each elapse of a given time.

Moreover, sucking of the sucking pump 27 is also used to control inner pressure of the nozzles. As being explained later, the ink cartridge 21 houses a negative pressure generation member to keep the inner pressure of the nozzles negative to the atmosphere. The sucking pump 27 adjusts the inner pressure of the nozzles to such a value that an ink meniscus is formed at or near the end of each nozzle.

Figure 2:
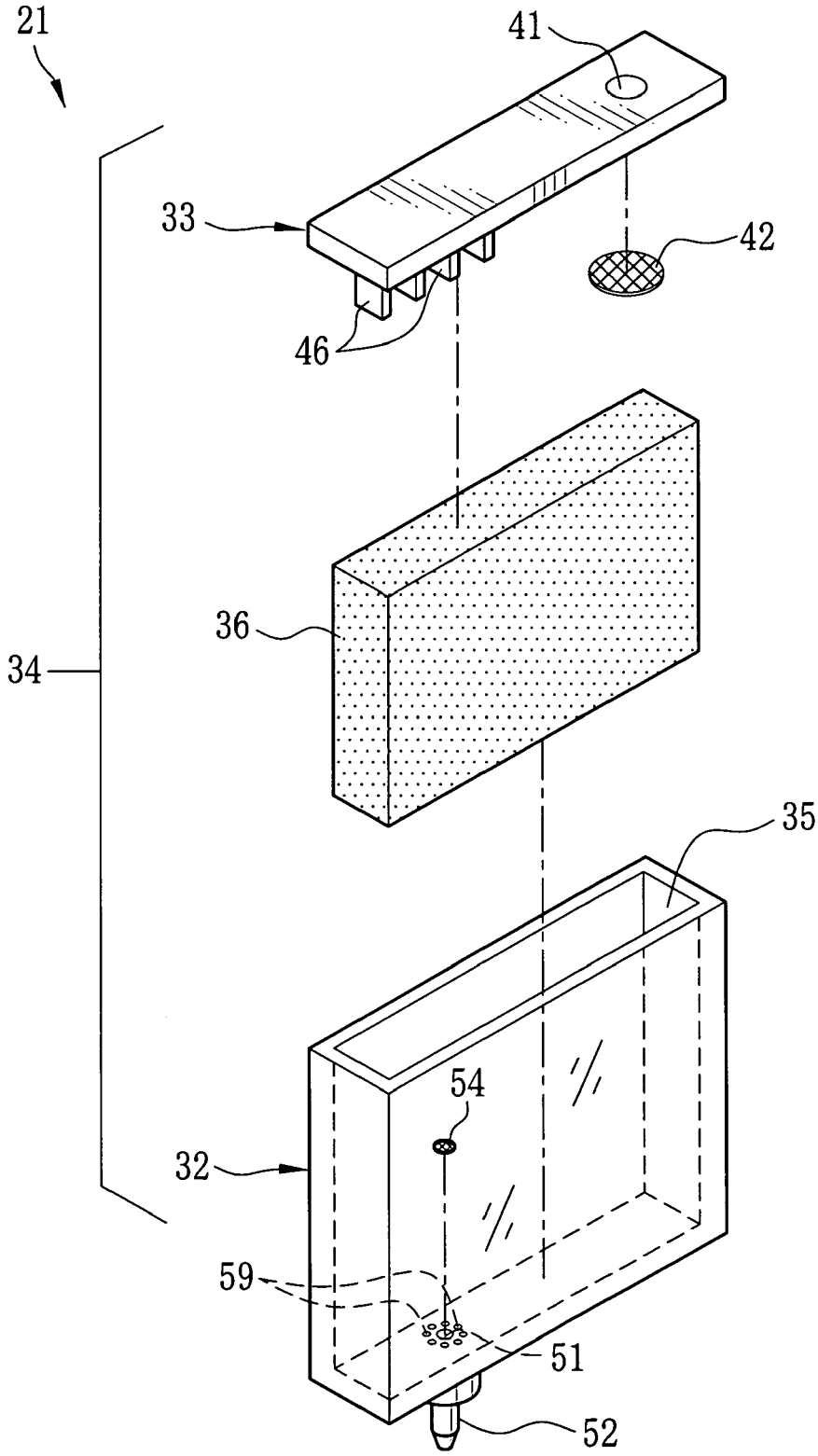
FIG. 2 is an exploded perspective view of an ink cartridge used in the ink jet recording apparatus of FIG. 1.

As shown in FIG. 2, the ink cartridge 21 is provided with a case 34 to store the ink. The case 34 consists of a case body 32 forming an ink chamber 35, and a lid 33 for closing an open top of the case body 32. The lid 33 is affixed to the case body 32, for example, by welding, after the case body 32 is filled with the ink. Thereby, the ink is prevented from leaking through the open top of the case body 32. The case body 32 is formed from a transparent plastic or the like, so the remaining amount of the ink in the ink cartridge 21 is visible from outside.

In the ink chamber 35, an ink absorbent 36 is placed to absorb and hold the ink. The ink absorbent 36 is a spongy material having micro holes that generate the capillary force. Concretely, the ink absorbent 36 is made of a porous material, including a foamed material like urethane foam, or a fibrous material like felt. The ink absorbent 36 has a width and a depth, which are approximately equal to a width and a depth of the ink chamber 35, so the ink absorbent 36 is contained in the ink chamber 35 with its peripheral surfaces, except the top surface, in contact with inner wall surfaces of the ink chamber 35.

Because the case 34 is disposed above the recording head 12, an ink load in the case 34 becomes positive to the recording head 12. Due to its capillary force, the ink absorbent 36 absorbs and holds the ink, and thus functions as a negative pressure generation member that generates a negative pressure in the nozzles of the recording head 12 relative to the atmosphere. Keeping the pressure in the nozzles negative to the atmosphere prevents the ink in the recording head 12 from unexpectedly leaking out of the nozzle.

In the lid 33, an air inlet 41 is formed for sending air into the ink chamber 35 by an amount corresponding to the consumption of the ink. On a bottom side of the lid 33, a gas-liquid separation filter 42 is arranged to cover the air inlet 41. The gas-liquid separation filter 42 does not let liquid through it, but only gas through it. So the filter 42 prevents the ink in the ink chamber 35 from leaking outside through the air inlet 41.

A plurality of ribs 46 are formed on the bottom side of the lid 33 in an area facing to the ink chamber 35. As the lid 33 is attached to the case body 32, the ribs 46 protrude into the ink chamber 35 and come into contact with a top surface of the ink absorbent 36, pressing down the ink absorbent 36 onto the bottom of the ink chamber 35. Thereby, the ink absorbent 36 is fixedly positioned to provide a room between the ink absorbent 36 and the lid 33, preventing the ink absorbent 36 from being displaced to close the air inlet 41.

An ink outlet 51 is formed through a bottom position of the ink chamber 35, for taking the ink out of the ink chamber 35 and supplying it to the recording head 12. A force-fitting member 52 like a spindle extends downward from the bottom position of the case 34 that corresponds to the ink outlet 51, and is force-fitted into the carriage 13.

Figure 3:
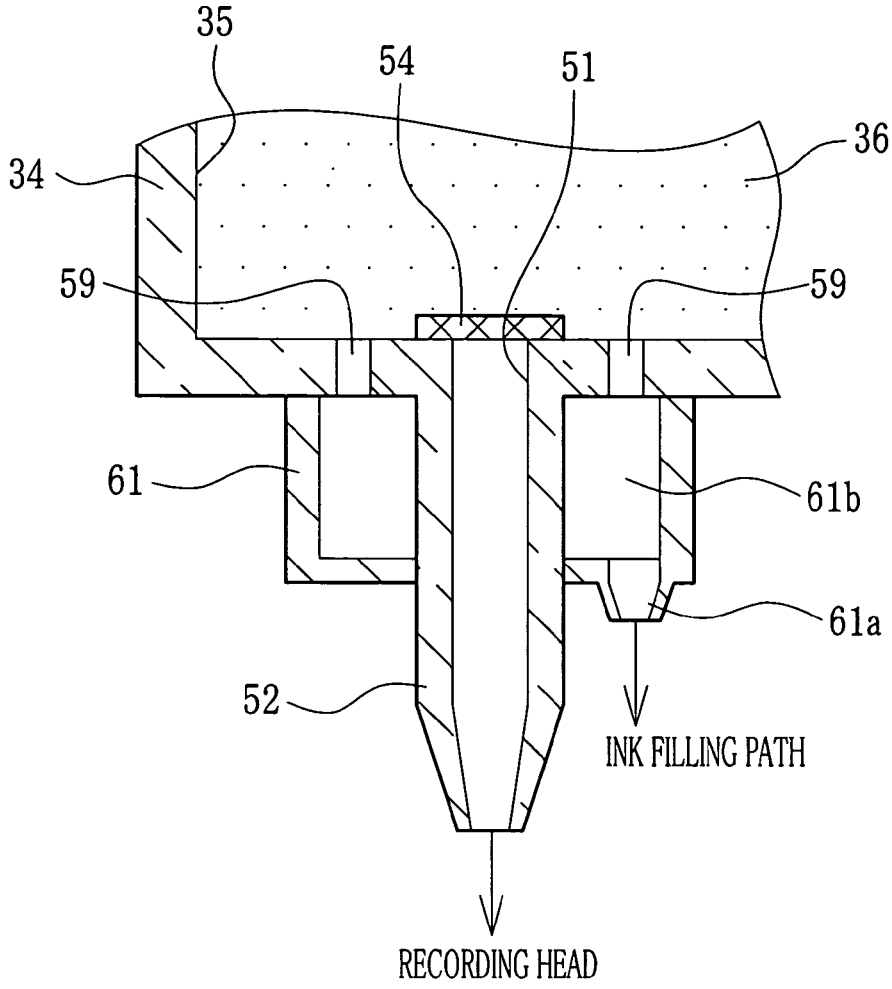
FIG. 3 is a fragmentary section of the ink cartridge, illustrating an ink outlet and ink filling openings.

As shown in FIG. 3, the ink outlet 51 pierces through the force-fitting member 52 down to a lower end of the force-fitting member 52. On the bottom position of the ink chamber 35 where the ink outlet 51 exits, a filter 54 being substantially flat is placed. The filter 54 filters the ink sent through the ink outlet 51 to the ink supply path, which prevents for example coagulated ink in the ink chamber 35 or foreign materials from flowing into the recording head 12.

Figure 4:
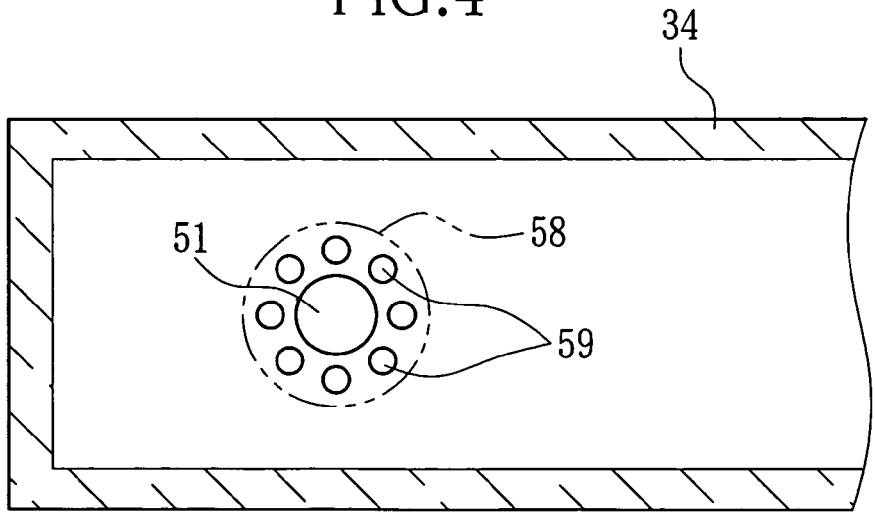
FIG. 4 is an explanatory diagram illustrating an example of arrangement of the ink filling openings.

As shown in FIG. 4, a plurality of ink filling openings 59 are formed in the bottom surface of the ink chamber 35 around the ink outlet 51. The ink filling openings 59 are used to fill the ink chamber 35 with the ink, and are disposed in a peripheral area 58 close to and surrounding the ink outlet 51. For example, the ink filling openings 59 are round-shaped, and are arranged in a circle at equal intervals around the ink outlet 51. As an aperture of the ink outlet 51 is small and a not-shown backflow valve as well as the filter 54 is placed, flow resistance through the ink outlet 51 is so large that it is difficult to inject the ink through the ink outlet 51. Since the ink filling openings 59 are formed besides the ink outlet 51, the flow resistance becomes smaller, so it becomes easier to inject the ink into the ink chamber 35.

As the sucking pump 27 sucks the recording head 12, the ink flows from the ink chamber 35 through the ink outlet 51 to the ink supply path. However, as mentioned for a conventional art, the ink often remains near and around the ink outlet, even while the recording head 12 is sucked by the sucking pump. Since the ink filling openings 59 are arranged in the peripheral area 58, it becomes possible to suck and clear off the ink residue around the ink outlet 51. Ink-refill after clearing off the ink residue prevents formation of air pools near the ink outlet 51. Thereby, the discharge stability of the recording head 12 improves.

At the base of the force-fitting member 52, a doughnuts-like cap 61 is provided to cover the ink filling openings 59, including their peripheral area. On a bottom wall of the cap 61, a connection port 61*a* is formed to connect the ink cartridge 21 to an ink refilling path. In the cap 61, there is a doughnuts-like cavity 61*b*, which interconnects the ink filling openings 59 with the connection port 61*a*.

Figure 5:
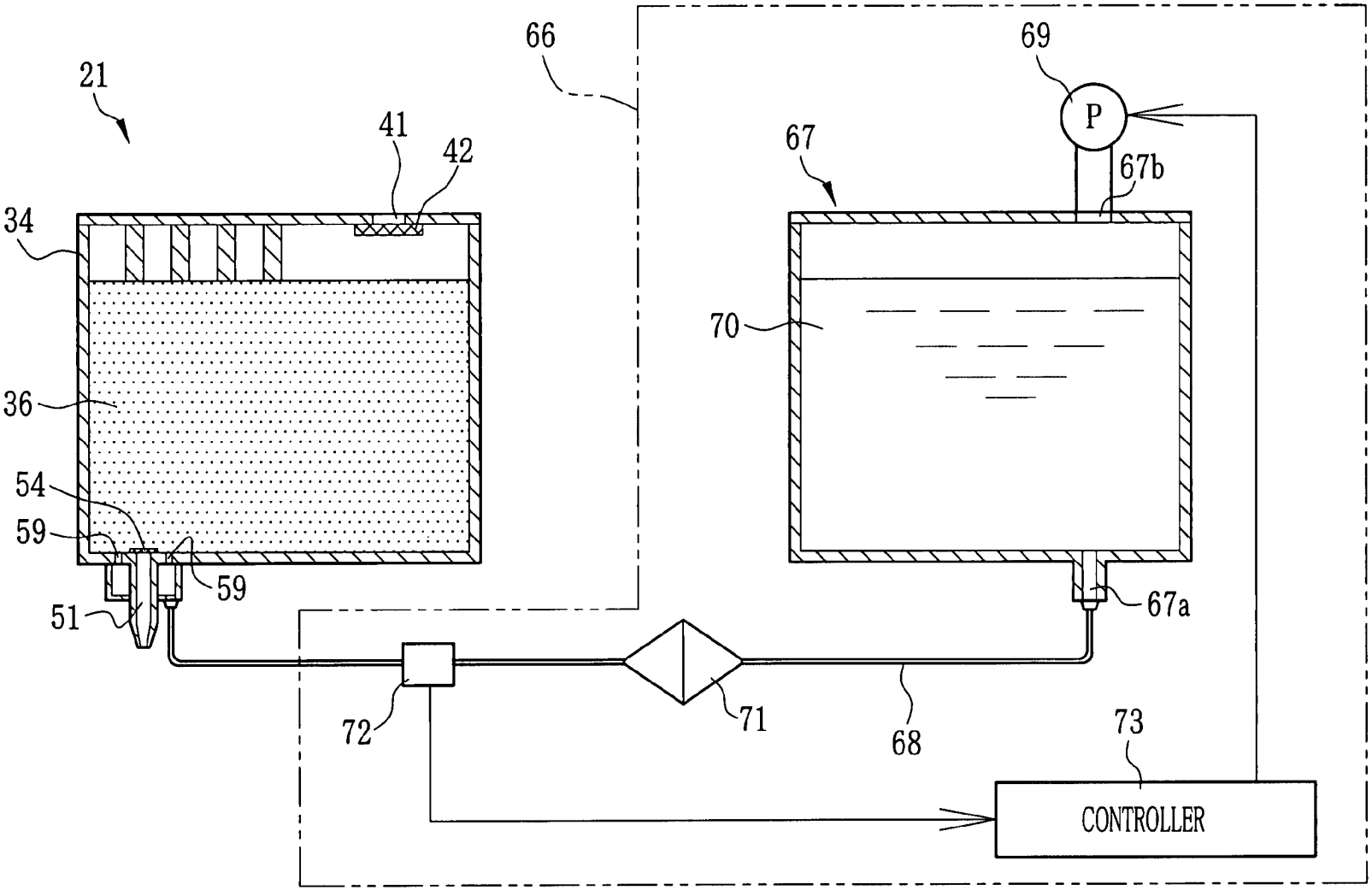
FIG. 5 is a schematic diagram illustrating an ink filling device.

FIG. 5 is a schematic diagram illustrating the structure of an ink filling apparatus 66. The ink filling apparatus 66 is provided with an ink supply tank 67 storing ink 70 to be supplied to the ink cartridge 21, an ink filling tube 68 constituting the ink refilling path, which connects the ink filling openings 59 of the ink cartridge 21 to the ink supply tank 67, and a pump mechanism 69 for sending the ink to the ink cartridge 21 through the ink filling tube 68 by applying pressure on the ink in the ink supply tank 67. The ink supply tank 67 has a connection port 67*a* at a lower position, which is connected to the ink filling tube 68, and another connection port 67*b* at an upper position, which is connected to the pump mechanism 69.

The pump mechanism 69 consists of a pump unit and a driving motor. By sending air to the ink supply tank 67, the pump mechanism 69 applies pressure on the ink in the ink supply tank 67 to fill the ink cartridge 21 with the ink. By rotating the driving motor backward, the air is sucked out of the ink supply tank 67, which reduces the inner pressure of the ink supply tank 67 and sucks the ink out of the ink cartridge 21. On the ink supply path are disposed a filter unit 71 to filter the ink, and an ink flow detection sensor 72 to detect whether the ink flows through the ink filling tube 68 or not. For example, an optical sensor, a supersonic sensor or the like is usable as the ink flow detection sensor 72. A controller 73 controls overall operations of the respective parts of the ink filling apparatus 66.

Figure 6A:
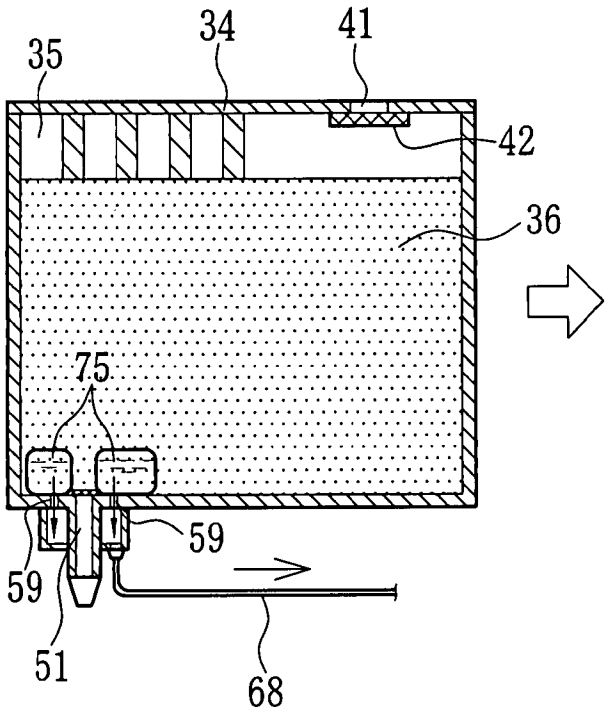
FIGS. 6A, 6B and 6C are explanatory diagrams illustrating a sequence of refilling the ink cartridge with ink by the ink filling device.

FIG. 6 illustrates a sequence of refilling the ink cartridge 21 with the ink. As shown in FIG. 6A, when the ink cartridge 21 is used up and replaced with another ink cartridge, the used ink cartridge 21 has some ink residue 75 around the ink outlet 51. Before the ink filling, the ink filling apparatus 66 rotates the driving motor of the pump mechanism 69 backward to suck the ink residue out of the ink chamber 35 through the ink filling openings 59 and the ink filling tube 68 into the ink supply tank 67.

Figure 6B:
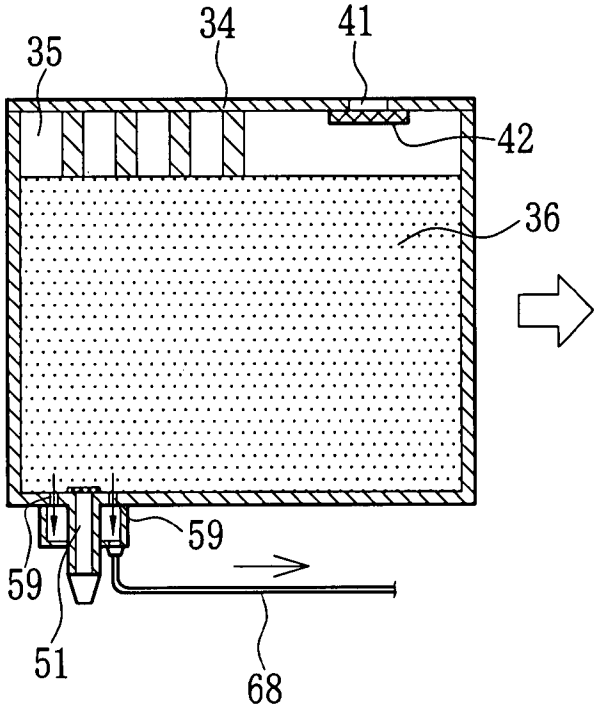

Thereby, as shown in FIG. 6B, the ink residue 75 is removed from around the ink outlet 51. Upon detecting by signals from the ink flow detection sensor 72 that the ink stops flowing through the ink filling tube 68, the controller 73 judges that there is no ink residue 75 in the ink chamber 35, and stops collecting the ink residue 75.

Figure 6C:
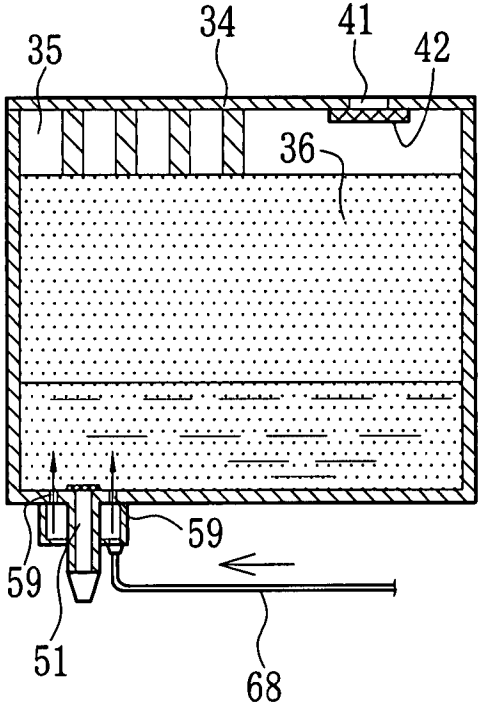

After collecting the ink residue, the controller 73 rotates the driving motor of the pump mechanism 69 forward to send the ink from the ink supply tank 67 through the ink filling tube 68 and the ink filling openings 59 into the ink chamber 35, as shown in FIG. 6C. Because the ink residue 75 is removed from around the ink outlet 51, the ink chamber 35 is filled with the ink without making any air pool around the ink outlet 51.

As the ink flows through the ink filling tube 68 in the reverse direction on sucking the ink to the ink filling direction, the filter unit 71 provided in the ink filling tube 68 is seldom clogged. Thereby, it is possible to extend the life of the filter unit 71. As described above, according to the conventional method of ink filling, an air outlet of an ink cartridge is connected to a sucking pump for the refill. In this case, there are concerns that a gas-liquid separation filter could get high pressure and be broken at worst. On the contrary, the present invention has nothing to do with such concerns because it applies pressure on the ink supply tank to send the ink into the ink cartridge through the ink filling openings.

Although the ink flow detection sensor is used to judge when to stop collecting the ink residue, it is possible to predetermine how long is enough to collect the ink residue and to decide to stop collecting after the predetermined time of sucking.

In the above described embodiment, eight round ink filling openings are arranged at equal intervals around the ink outlet. The number of the ink filling openings, however, is not limited to eight but can be more or less than eight. In addition, the shape of the ink filling opening is not limited to be round but can be oval, elongated hole, or other shapes. It is also possible to arrange plural ink filling openings at different intervals instead of at equal intervals.

Figure 7A:
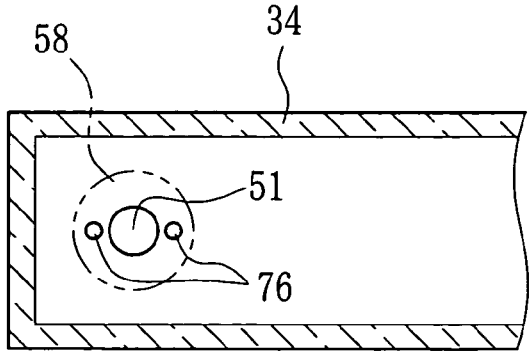
FIGS. 7A, 7B, 7C and 7D are explanatory diagrams illustrating variations of arrangement of ink filling openings.
Figure 7B:
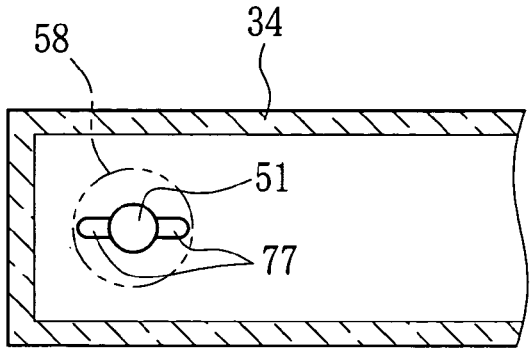

As the ink filling openings only need to be disposed to make it easy to remove the ink residue around the ink outlet, various embodiments are possible instead of the above described arrangements. FIGS. 7A and 7B illustrate embodiments wherein a couple of ink filling openings 76 and 77 are disposed across the ink outlet 51 from each other. While the ink filling openings 76 are round, the ink filling openings 77 are oblong. The ink filling openings 76 and 77 are respectively placed at intervals of 180 degrees. In this layout, it is easier to remove the ink residue from the ink outlet 51, compared to the layout where the two ink filling openings are placed closer in one side of the ink outlet 51.

Figure 7C:
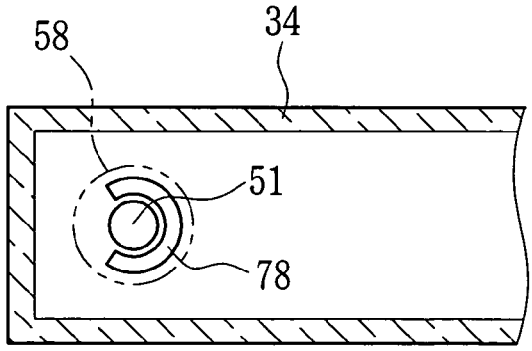
Figure 7D:
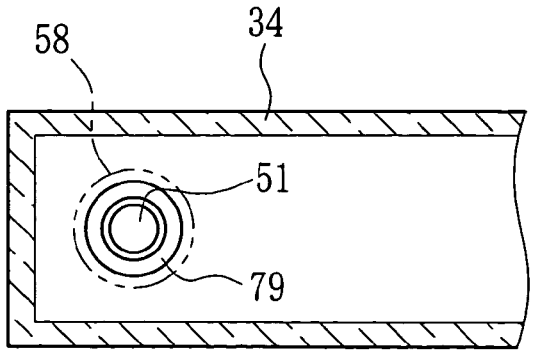

FIGS. 7C and 7D illustrate embodiments wherein an ink filling opening 78 or 79 is formed to surround the ink outlet 51. While the ink filling opening 79 is a ring-like shape which surrounds all circumference of the ink outlet 51, the ink filling opening 78 is a C letter-like shape which surrounds a part of the circumference. It is desirable for the ink filling opening 78 to surround over half of the circumference of the ink outlet 51.

The above described embodiments have been described with respect to the cartridge type ink container which can be attached to and removed from the ink jet recording apparatus. However, the invention is applicable to an ink container which is fixedly attached to an ink jet recording apparatus. In this case, it is necessary to provide the ink jet recording apparatus with an ink filling function.

Figure 8:
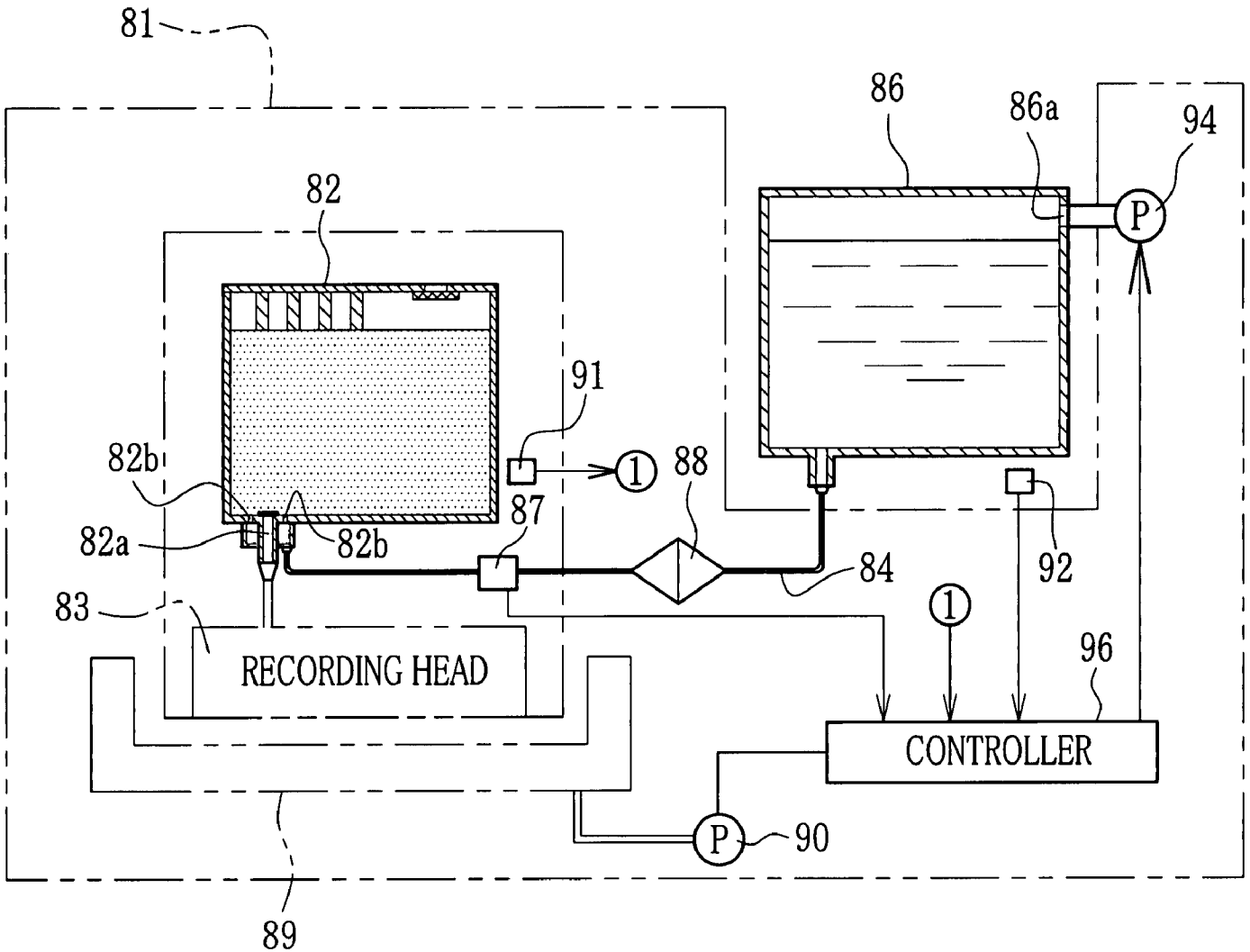
FIG. 8 is an explanatory diagram illustrating an ink jet recording apparatus provided with an ink filling device.

FIG. 8 illustrates an ink jet recording apparatus 81 provided with an ink filling function. The ink jet recording apparatus 81 is fixedly provided with an ink container 82 whose ink outlet 82*a* is connected to a recording head 83 through an ink supply path. In a peripheral area surrounding the ink outlet 82*a*, an ink filling openings 82*b* are disposed in the same way as the above described embodiment. The ink filling openings 82*b* are connected to an ink supply tank 86 through an ink filling tube 84. In the track of the ink filling tube 84, an ink flow detection sensor 87 and a filter unit 88 are arranged.

Designated by 89 is a head cap that is used to mend a defective discharge of the recording head 12, and is connected to a sucking pump 90. Driving the sucking pump 90 sucks ink out of nozzles of a recording head 12. Designated by 91 and 92 are remaining ink detection sensors to detect the remaining amount of ink in the ink container 82 and in the ink supply tank 86, respectively. The ink supply tank 86 is detachably set in the ink jet recording apparatus 81. When the ink supply tank 86 is attached in the ink jet recording apparatus 81, a connection port 86*a* of the ink supply tank 86 comes into contact with a pump mechanism 94, which is driven to make pressure in the ink supply tank 86 increase or decrease. A controller 96 controls overall operation of the respective parts of the ink jet recording apparatus 81.

When the remaining ink detection sensor 91 detects that the remaining amount of ink in the ink container 82 decreases, the controller 96 detects the good time for refilling the ink container 82 with ink. When the time for ink refilling has come, the controller 96 controls the pump mechanism 94 in the same sequence as described with reference to FIG. 6, to collect ink residue from the ink container 82, and thereafter fill the ink container 82 with the ink from the ink supply tank 86.

After completing the ink filling, the controller 96 drives the sucking pump 90 to make the head cap 89 suck the ink out of the nozzles, which results in adjusting inner pressure of the nozzle. In addition, when the remaining ink detection sensor 92 detects the time to exchange the ink supply tank 86, the controller 96 warns and promotes to exchange the ink supply tank 86.

Figure 9B:
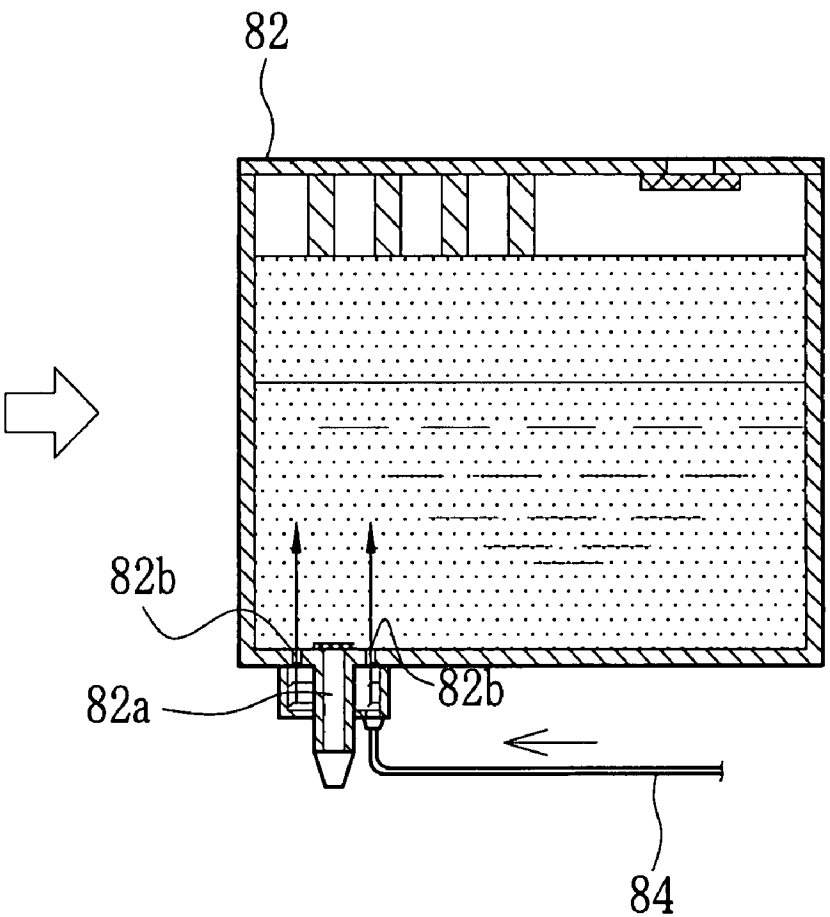
FIGS. 9A and 9B are explanatory diagrams illustrating a sequence of refilling the ink cartridge with ink, wherein recovery of ink residue from the ink cartridge is not carried out.
Figure 9A:
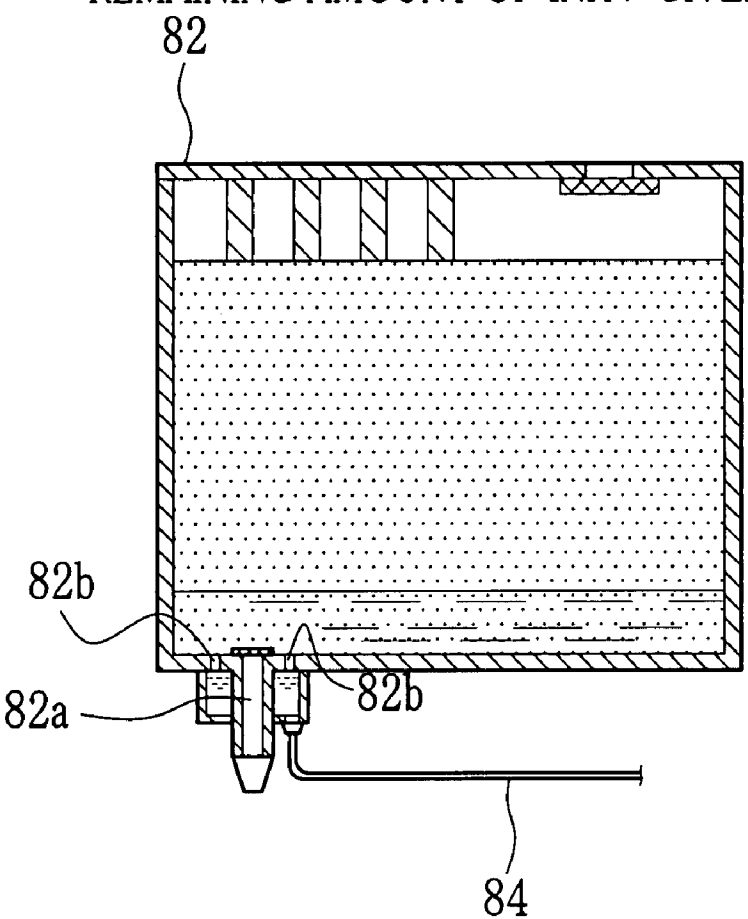

As shown in FIG. 9, when the remaining amount of ink is larger than a given value at the time of ink refilling, it is possible to do the ink refill without collecting the ink residue. When the ink outlet 82*a* is filled with the ink residue, there is no concern that an air pool could be made, even if the ink residue collection process is skipped.

It is also possible to switch over between the first ink filling mode as shown in FIG. 6 and the second ink filling mode as shown in FIG. 9 according to the remaining amount of ink at the time of ink refill. Though the time for ink filling is detected from the remaining amount of ink in the ink container 82, it is also possible to detect by counting a running amount of an inkjet recording apparatus such as the number of ink ejections from the recording head or the number of printed images. In case where the head cleaning by the head cap is carried out every given period, it is possible to detect the time for ink refill based on how many times the head cleaning is carried out, because there is a correlation between the number of times of head cleaning and the running amount of the inkjet recording apparatus.

Figure 10:
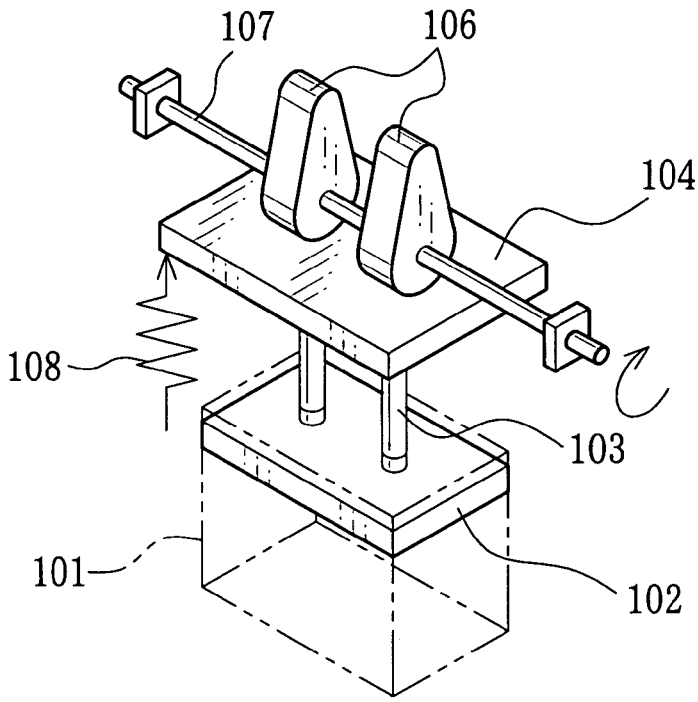
FIG. 10 is a perspective view illustrating a pump mechanism of an ink supply tank.
Figure 11:
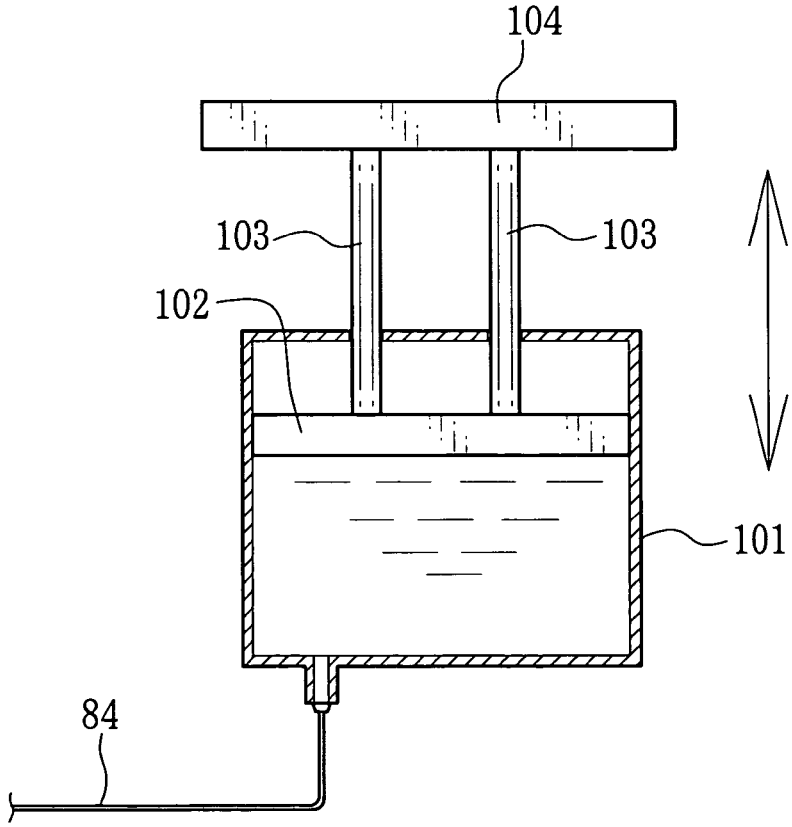
FIG. 11 is a sectional view of the pump mechanism of FIG. 10.
Figure 12A:
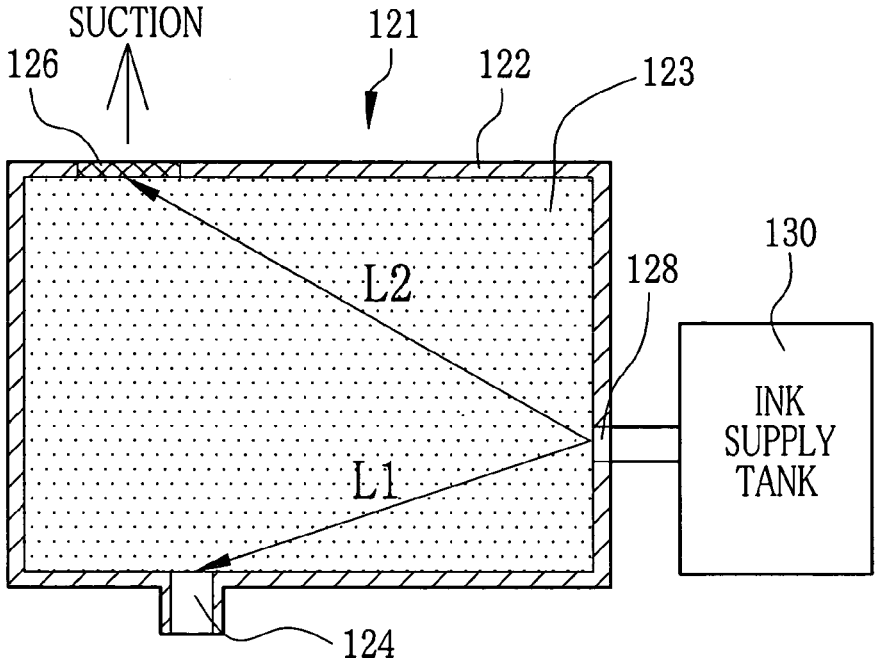
FIG.12A (PRIOR ART)
FIG. 12 is an explanatory diagram illustrating an ink refilling method of a prior art.
Figure 12B:
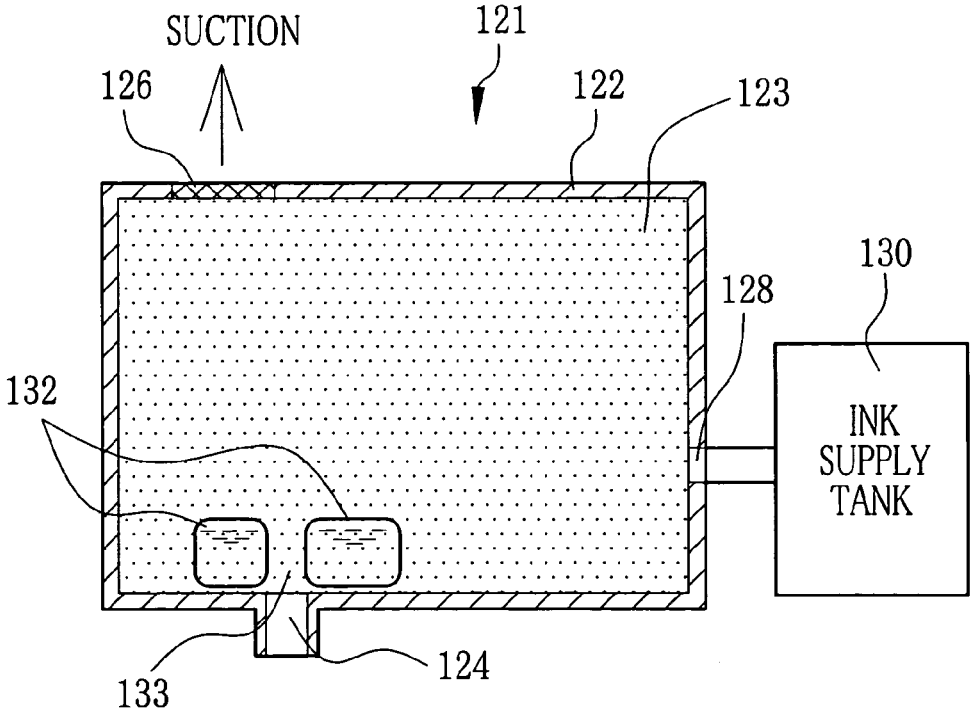
FIG.12B (PRIOR ART)

In the above described embodiment, the pump mechanism compresses or decompresses ink in the ink supply tank by sucking or exhausting air. Alternatively, as shown in FIGS. 10 and 11, it is possible to use an ink supply tank 101 as a cylinder and provide the ink supply tank 101 with a working member 102 that serves as a piston, both of which constitute a pump mechanism. The working member 102 is mounted movable in a vertical direction in the ink supply tank 101. As the working member 102 goes down, the capacity of containing the ink in the ink supply tank 101 decreases, and its inner pressure increases. Thereby, ink is compressed and sent to an ink tank through an ink filling tube. On the other hand, when the working member 102 goes up, the volume to contain ink in the ink supply tank 101 increases and its inner pressure decreases. Thereby, the ink is collected from the ink container through the ink filling tube into the ink supply tank 101.

The working member 102 is mounted to one ends of column supports 103. The other ends of the column supports 103 are affixed to a pressing board 104 that is located outside the ink supply tank 101. The pressing board 104 is biased by a spring 108 upward, that is, toward a position where the pressing board 104 comes to contact with a camshaft 107 that is provided with a pair of cams 106. As the pair of cams 106 rotate with the camshaft 107, the pressing board 104 is moved up and down. Thereby, the working member 102 moves up and down.

Although the present invention has been described with reference to the preferred embodiments, the present invention is not to be limited to the above embodiments but, on the contrary, various modifications will be possible without departing from the scope of claims appended hereto.

What is claimed is:

1. An ink container containing ink to be supplied to an ink jet type recording head, said ink container comprising:

a case formed with an ink chamber for containing the ink;

an ink outlet formed through said case and connected to an ink supply path which leads to said recording head;

a negative pressure generation member placed in said ink chamber, said negative pressure generation member absorbing and holding the ink by its capillary force to keep pressure inside said recording head negative to atmospheric pressure;

an air inlet formed through said case, for introducing air into said ink chamber with consumption of the ink in said ink chamber; and at least an ink filling opening formed through said case in a peripheral area around said ink outlet, said ink filling opening being used to fill said ink chamber with the ink.

2. An ink container as claimed in claim 1, wherein a plurality of said ink filling openings are arranged at equal intervals in a circle around said ink outlet.

3. An ink container as claimed in claim 2, wherein a couple of said ink filling openings are arranged across said ink outlet from each other.

4. An ink container as claimed in claim 3, wherein said ink filling openings are round or oblong.

5. An ink container as claimed in claim 1, wherein said ink filling opening is an almost annular opening that surrounds said ink outlet.

6. An ink container as claimed in claim 5, wherein said ink filling opening surrounds over half of a circumference of said ink outlet.

7. An ink container as claimed in claim 6, wherein said ink filling opening surrounds all the circumference of said ink outlet.

8. An ink container as claimed in claim 1, wherein said ink outlet and said ink filling opening are formed through a bottom wall of said ink chamber.

9. An ink container as claimed in claim 1, wherein said ink container is a cartridge that is detachably attached to an ink jet recording apparatus provided with said recording head.

10. An ink jet recording apparatus comprising:

a recording head that discharges ink to print an image; and at least an ink container containing the ink to be supplied to said recording head, said ink container comprising a case forming an ink chamber, an ink outlet formed through said case and connected to said recording head, a negative pressure generation member placed in said ink chamber, for absorbing and holding the ink by its capillary force to keep pressure inside said recording head negative to atmospheric pressure, an air inlet formed through said case, for introducing air into said ink chamber with consumption of the ink in said ink chamber, and at least an ink filling opening formed through said case in a peripheral area around said ink outlet, said ink filling opening being used to fill said ink chamber with the ink.

11. An ink jet recording apparatus as claimed in claim 10, further comprising an ink supply tank that contains ink to be supplied to said ink container, an ink filling path that connects said ink supply tank to said ink filling opening of said ink container, and a pump device that applies pressure to the ink in said ink supply tank, to send the ink from the ink supply tank through said ink filling path into said ink container.

12. An ink jet recording apparatus as claimed in claim 11, wherein said pump device reduces pressure inside said ink supply tank, to suck ink residue staying around said ink outlet out of said ink container through said ink filling opening and collect the ink residue through said ink filling path into said ink supply tank, before starting refilling said ink container with the ink.

13. An ink jet recording apparatus as claimed in claim 12, wherein a filter is disposed in said ink filling path, for filtering the ink as flowing through said ink filling path.

14. An ink jet recording apparatus as claimed in claim 11, further comprising a detection device for detecting an ink filling time to fill said ink container with the ink from said ink supply tank, and a control device for controlling said pump based on a detection signal from said detection device.

15. An ink jet recording apparatus as claimed in claim 14, further comprising a device for detecting a remaining amount of ink in said ink container, wherein if the remaining amount of ink is less than a given amount at the ink filling time, said control device executes a first filling mode wherein the ink is sent from said ink supply tank to said ink container after the ink is sucked out of said ink container, whereas if the remaining amount of ink is not less than the given amount at the ink filling time, said control device executes a second filling mode wherein the ink is sent from said ink supply tank to said ink container without the ink residue being sucked out of said ink container.

16. An ink jet recording apparatus as claimed in claim 11, wherein said ink container and said recording head are fixedly mounted in said ink jet recording apparatus, and said ink supply tank is detachably attached to said ink jet recording apparatus.

17. A method of filling an ink container with ink, wherein said ink container comprises a case forming an ink chamber for containing the ink, an ink outlet formed through said case and connected to an ink supply path that leads to an ink jet type recording head, a negative pressure generation member placed in said ink chamber, for absorbing and holding the ink by its capillary force to keep pressure inside said recording head negative to atmospheric pressure, an air inlet formed through said case, for introducing air into said ink chamber with consumption of the ink in said ink chamber, and at least an ink filling opening formed through said case in a peripheral area around said ink outlet, said method comprising steps of:

sucking ink residue that stays around said ink outlet through said ink filling opening out of said ink chamber; and inject, thereafter, the ink through said ink filling opening into said ink chamber.

18. An ink filling device for filling an ink container with ink, wherein said ink container comprises a case forming an ink chamber for containing the ink, an ink outlet formed through said case and connected to an ink supply path that leads to an ink jet type recording head, a negative pressure generation member placed in said ink chamber, for absorbing and holding the ink by its capillary force to keep pressure inside said recording head negative to atmospheric pressure, an air inlet formed through said case, for introducing air into said ink chamber with consumption of the ink in said ink chamber, and at least an ink filling opening formed through said case in a peripheral area around said ink outlet, said ink filling device comprising:

an ink supply tank containing ink to be supplied to said ink container;

an ink filling path connecting said ink supply tank to said ink filling opening of said ink container; and a pump device that applies pressure to the ink in said ink supply tank, to send the ink from the ink supply tank through said ink filling path into said ink container, wherein said pump device sucks ink residue staying around said ink outlet out of said ink container through said ink filling opening, before starting refilling said ink container with the ink.

* * * * *